US010770775B2

(12) United States Patent
Kinsey

(10) Patent No.: US 10,770,775 B2
(45) Date of Patent: Sep. 8, 2020

(54) RADIAL COMBINER

(71) Applicant: SAAB Defense and Security USA LLC t/a Sensor System, East Syracuse, NY (US)

(72) Inventor: Richard Kinsey, East Syracuse, NY (US)

(73) Assignee: SAAB DEFENSE AND SECURITY USA LLC T/A SENSOR SYSTEM NY (US)

( * ) Notice: Subject to any disclaimer, the term of this patent is extended or adjusted under 35 U.S.C. 154(b) by 0 days.

(21) Appl. No.: 16/003,910

(22) Filed: Jun. 8, 2018

(65) Prior Publication Data

US 2019/0379098 A1 Dec. 12, 2019

(51) Int. Cl.

| | |
|---|---|
| ***H01P 5/16*** | (2006.01) |
| ***H01P 3/06*** | (2006.01) |
| ***H01P 3/12*** | (2006.01) |

(52) U.S. Cl.

CPC ..... *H01P 5/16* (2013.01); *H01P 3/06* (2013.01); *H01P 3/12* (2013.01)

(58) Field of Classification Search

CPC ..... H01P 5/12; H01P 5/16; H01P 3/12; H01P 3/06

See application file for complete search history.

(56) References Cited

U.S. PATENT DOCUMENTS 4,562,409 A 12/1985 Saito et al.
4,590,446 A 5/1986 Hsu et al.
4,641,106 A * 2/1987 Belohoubek ..... H03F 3/602 330/286
4,641,107 A 2/1987 Kalokitis
4,647,879 A 3/1987 Vaddiparty
4,684,874 A 8/1987 Swift et al.
4,700,145 A 10/1987 Yelland et al.
4,926,145 A 5/1990 Flam et al.
4,933,651 A 6/1990 Benahim et al.
4,956,614 A * 9/1990 Baril ..... G01S 7/282 330/286

(Continued)

OTHER PUBLICATIONS

Fathey et al., "A simplified design approach for radial power combiners," IEEE Transactions on Microwave Theory and Techniques 54.1 (2006): 247-255.

(Continued)

*Primary Examiner* — Robert J Pascal
*Assistant Examiner* — Kimberly E Glenn
(74) *Attorney, Agent, or Firm* — Barnes & Thornburg LLP

(57) ABSTRACT

Systems and methods of use for a radial combiner. The radial combiner is made of a radial cavity defined by a top plate, a bottom plate, an outside wall connecting the top plate and the bottom plate, and an interior of the radial waveguide cavity located between the top plate, the bottom plate, and the outside wall with a substantially uniform height throughout. Inside the radial cavity are multiple monopole radiators, while outside the radial cavity multiple coaxial ports are mounted on one of the top plate or the bottom plate. Each of the coaxial ports are electrically connected to a corresponding monopole radiator inside the cavity. The radial combiner also contains a center conductor which is located in the center of the radial cavity, and transitions to a coaxial waveguide which is exterior to the cavity.

20 Claims, 4 Drawing Sheets

(56) References Cited

U.S. PATENT DOCUMENTS

| | | | | |
|---|---|---|---|---|
| 5,446,426 | A | 8/1995 | Wu et al. | |
| 6,242,984 | B1 | 6/2001 | Stones et al. | |
| 7,113,056 | B2 | 9/2006 | Wu et al. | |
| 7,312,673 | B2 | 12/2007 | Wu et al. | |
| 7,385,462 | B1 | 6/2008 | Epp et al. | |
| 7,482,894 | B2 | 1/2009 | Wu et al. | |
| 8,427,382 | B2 | 4/2013 | Crouch | |
| 8,558,620 | B2 | 10/2013 | Fraysse et al. | |
| 8,928,429 | B2 | 1/2015 | Song et al. | |
| 9,065,163 | B1 * | 6/2015 | Wu | H01P 3/12 |
| 9,287,605 | B2 | 3/2016 | Daughenbaugh, Jr. et al. | |
| 9,419,323 | B2 | 8/2016 | Shinohara et al. | |
| 9,490,517 | B2 | 11/2016 | Wu et al. | |
| 9,509,034 | B2 | 11/2016 | Xue et al. | |
| 9,673,503 | B1 | 6/2017 | Aster | |
| 9,774,069 | B2 | 9/2017 | Crouch | |
| 9,793,591 | B1 | 10/2017 | Aster | |
| 9,825,349 | B2 | 11/2017 | Chieh et al. | |
| 9,917,343 | B2 | 3/2018 | Chieh et al. | |
| 10,164,667 | B1 * | 12/2018 | Kitt | H04B 1/04 |
| 2006/0284701 | A1 | 12/2006 | Wu et al. | |
| 2007/0063791 | A1 | 3/2007 | Wu et al. | |
| 2015/0255845 | A1 | 9/2015 | Heid et al. | |

OTHER PUBLICATIONS

Song et al., "Compact U-band 32-way ring-cavity spatial power combiner with low insertion loss," Electronics letters 48.18 (2012): 1133-1134.

Jain et al., "High-power, low-loss, radial RF power dividers/combiners," Asian Particle Accelerator Vonference APAC07 (2007).

OrbitFR, "Radial Power Combiners Datasheet," Microwave Vision Group (2013).

Dirk I L. de Villiers, Pieter W. van der Walt, Petrie Meyer, "Design of a Ten-Way Conical Transmission Line Power Combiner", IEEE MTT Transactions, vol. 55, No. 2, Feb. 2007, pp. 302-308.

Ryno D. Beyers, Dirk I. L. de Villiers, "Compact Conical-Line Power Combiner Design Using Circuit Models", IEEE MTT Transactions, vol. 62, No. 11, Nov. 2014, pp. 2650-2658 + Ryno D. Beyers and Dirk I. L. de Villiers, Corrections to "Compact Conical-Line Power Combiner Design Using Circuit Models", IEEE MTT Transactions, vol. 63, No. 7, Jul. 2015, p. 2391.

N. Marcuvitz, Waveguide Handbook, MIT Radiation Laboratory Series, vol. 10, 1951, pp. 89-96.

* cited by examiner

RADIAL COMBINER

BACKGROUND

1. Technical Field

The present disclosure relates to a radial combiner, and more specifically to a radial combiner lacking internal dielectric, metallic or resistive components, within the radial cavity.

2. Introduction

Microwave dividers receive a microwave signal, divide the signal into N parts, and forward each of those divided parts to a power amplifier or other signal manipulation tool. Microwave combiners perform the same function in reverse, taking multiple signals, amplifying the multiple signals, then combining the amplified signals into a single output. In certain configurations, a single device can be used as either a divider or a combiner, depending on the source of the device input(s). When the N inputs/outputs are arranged in a circle, these devices are called radial combiners, radial dividers, or radial combiner/dividers.

With a few exceptions, conventional radial dividers/combiners fall into one of two categories, namely a "stripline waveguide" configuration or a "peripheral rectangular waveguide" configuration. The most prevalent category, the stripline waveguide configuration, consists of a circular metallic conductor at the center of a radial waveguide, the radial waveguide connecting to a series of radial microstrip or stripline conductors circumferentially spaced and each connecting to a peripheral coax connector. The peripheral rectangular waveguide configuration consists of a series of peripherally spaced co-planar rectangular waveguides directed toward the center of the structure, where the waveguide ends join contiguously in a central circular region to excite a radial TEM mode that couples to a coaxial waveguide at the center.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

An exemplary embodiment of radial combiner as disclosed herein can include a radial waveguide cavity defined by: a top plate having a circular cross-section and a metallic composition; a bottom plate having a circular cross-section, a metallic composition, and being situated substantially parallel to the top plate; an outside wall connecting the top plate and the bottom plate along a circumference of at least one of the top plate and the bottom plate; and an interior of the radial waveguide cavity located between the top plate, the bottom plate, and the outside wall with a substantially uniform height throughout. The radial combiner can also include a plurality of monopole radiators located within the interior of the radial waveguide cavity and a plurality of coaxial ports mounted on one of the top plate or the bottom plate, mounted exterior to the radial waveguide cavity, and substantially equally spaced towards a periphery of the radial waveguide cavity. Each coaxial port in the plurality of coaxial ports can be mounted normal to the circular cross-section of the top plate or the bottom plate, and having a coaxial center conductor which extends through a hole in one of the top plate and the bottom plate, the coaxial center conductor of each coaxial port being electrically connected to one of the respective monopole radiators for each coaxial port within the interior of the radial waveguide cavity. The radial combiner can also have a center conductor, wherein the center conductor is located substantially at a center of the interior of the radial waveguide cavity, is normal to the circular cross-section of the top plate or the bottom plate, extends within the interior of the radial waveguide cavity between the top plate and the bottom plate, transitions, on a first side of the interior, to a coaxial waveguide located exterior to the radial waveguide cavity, and terminates on a second side of the interior which is opposite the first side.

An exemplary method embodiment as disclosed herein can include: receiving a plurality of first signals at a plurality of coaxial ports equally spaced towards a periphery of a radial waveguide, and combining the plurality of first signals using a microwave combiner. The microwave combiner can include a radial waveguide cavity defined by: a top plate having a circular cross-section and a metallic composition; a bottom plate having a circular cross-section, a metallic composition, and being situated substantially parallel to the top plate; an outside wall connecting the top plate and the bottom plate along a circumference of at least one of the top plate and the bottom plate; and an interior of the radial waveguide cavity located between the top plate, the bottom plate, and the outside wall with a substantially uniform height throughout. The microwave combiner can have a plurality of monopole radiators located within the interior of the radial waveguide cavity, a plurality of coaxial ports mounted on one of the top plate or the bottom plate, mounted exterior to the radial waveguide cavity, and substantially equally spaced towards a periphery of the radial waveguide cavity. Each coaxial port in the plurality of coaxial ports can be mounted normal to the circular cross-section of the top plate or the bottom plate and have a coaxial center conductor which extends through a hole in one of the top plate and the bottom plate, the coaxial center conductor of each coaxial port being electrically connected to one of the respective monopole radiators for each coaxial port within the interior of the radial waveguide cavity. The microwave combiner can also have a center conductor which is located substantially at a center of the interior of the radial waveguide cavity, is normal to the circular cross-section of the top plate or the bottom plate, extends within the interior of the radial waveguide cavity between the top plate and the bottom plate, transitions, on a first side of the interior, to a coaxial waveguide located exterior to the radial waveguide cavity, and terminates on a second side of the interior which is opposite the first side.

Another exemplary embodiment of a radial combiner as disclosed herein can include a hollow cylindrical cavity, wherein the hollow cylindrical cavity: is metallic; is defined by a first plate as a top of the hollow cylindrical cavity, a second plate as a bottom of the hollow cylindrical cavity, and an outside wall as a side of the hollow cylindrical cavity, the first plate being substantially parallel to the second plate; and has a substantially uniform height between the first plate and the second plate. The radial combiner can also include a plurality of coaxial ports mounted exterior to the hollow cylindrical cavity and on either one of the first plate or the second plate, and a plurality of monopole radiators substantially equally spaced around a circle and attached to an interior of one of the first plate or the second plate, each monopole radiator being electrically connected respectively to one of the plurality of coaxial ports using a coaxial center conductor extending through a hole in the one of the first plate or the second plate. The radial combiner can include a center conductor, where the center conductor is located substantially at a center of an interior of the hollow cylindrical waveguide cavity, is normal to the circular cross-section of the first plate or the second plate, extends within the interior of the hollow cylindrical cavity between the first plate and the second plate, transitions, on a first side of the interior, to a coaxial waveguide located exterior to the hollow cylindrical cavity, and terminates, on a second side of the interior which is opposite the first side.

DETAILED DESCRIPTION

Figure 1:
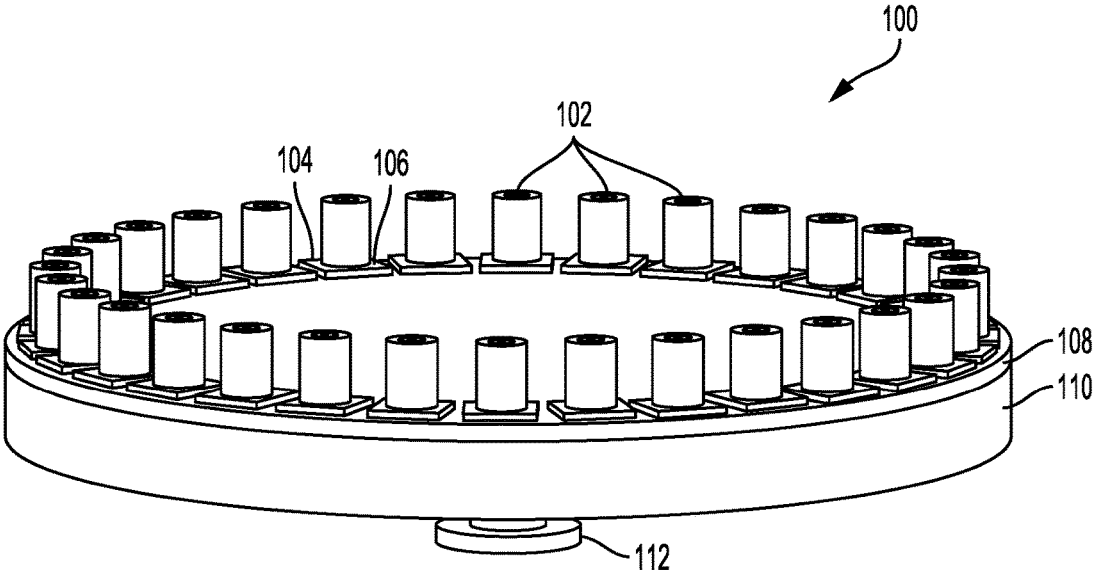
FIG. 1 illustrates an isometric view of an exemplary radial combiner.

Various embodiments of the disclosure are described in detail below. While specific implementations are described, it should be understood that this is done for illustration purposes only. Other components and configurations may be used without parting from the spirit and scope of the disclosure.

The principles disclosed herein apply equally to radial combiners and radial dividers. For example, the concepts and disclosure contained herein directed to combining signals using a radial combiner can also be applied to a radial divider dividing a signal. Unless otherwise stated, examples provided using the term "radial combiner" should be interpreted to also apply to radial dividers.

As realized by the inventor, stripline waveguide configurations and peripheral rectangular waveguide configurations for radial combiners can suffer deficiencies, specifically regarding the resources required for their construction and the resulting outputs of such configurations. For example, aspects such as dielectrics within the radial combiner, use of incorporated air, positioning of the peripheral coaxial ports, etc., can increase the time, costs, and materials needed to manufacture a radial combiner.

In contrast, as discovered by the inventor, radial combiners as disclosed herein can be constructed in complete absence of any internal dielectrics, resistors, or additional metallic structures. This absence can minimize the internal propagation loss while accommodating high microwave power levels. Preferably, radial combiners built according to this disclosure can provide peripheral coaxial ports which are normal to one of the parallel radial waveguide walls, rather than co-planar with the parallel radial waveguide walls (and normal to an outside wall connecting the parallel radial waveguide walls). Likewise, to improve reliability while minimizing the cost of fabrication, radial waveguides constructed according to this disclosure can employ a substantially uniform height which simplifies the design, improves the reliability, and minimizes cost of fabrication. Moreover, the radial waveguide disclosed herein can use a coax conductor which extends (using a coaxial center conductor) through a plate into a monopole probe, where the coaxial center conductor to monopole probe connection yields an insertion loss lower than the loss of an end-on coax launcher. The monopole probes for a radial combiner are monopole radiators, where a signal is input from the coax center conductor, then radiated within the central cavity from the corresponding monopole radiator. If, instead of a radial combiner the embodiment is acting as a radial divider, the monopole probes will act as monopole collectors, not radiators.

The peripheral coax ports are capable of receiving/transmitting signals, and can include any RF (Radio Frequency) capable connector, for example SMA (SubMiniature version A), TNC (Threaded Neill-Concelman), and Type-N peripheral connectors, with the choice depending on the microwave power level and Solid-State Module interface requirements. For any frequency band, EM (Electromagnetic) simulations using the disclosed concepts and designs predict the same insertion loss and active return loss for any of the connectors selected. If a larger sized coax connector is selected, the only corresponding design difference would be an increase in the radius of the radial waveguide to accommodate the peripheral spacing of the larger sized coax connectors.

Consider the example of a 32-way radial combiner for C-band frequencies. Such an exemplary radial combiner can be formed by two metallic, cylindrical plates having parallel (or substantially parallel) planes, with a coaxial waveguide port at the center, and having a peripheral wall bridging the two cylindrical plates. Around the periphery of the radial waveguide are equally spaced holes in one of the two parallel plates. These holes are offset a fraction of a wavelength toward the center from the peripheral wall bridging the two cylindrical plates. Coax connectors are located at each hole with the center conductor of the coax connector extending into the space between the two plates, forming a monopole probe within the cavity between the two plates. The number of peripheral coax connectors in this example is thirty two. While this number is not restricted to any particular number, the number of connectors is typically between 10 and 100, and is based on the ratio of the total desired divider/combiner power to the power of an individual coaxial port. For efficient power combining, the individual port signals are all required to be essentially equi-amplitude and equi-phase (i.e., within a threshold range).

Continuing this example, the distance (or height) between the two parallel circular metallic plates is preferably less than one-half a wavelength at the uppermost frequency of operation. Of the radial waveguide modes, only the dominant TEM (Transverse Electromagnetic) mode is supported. The hole, or opening, at the center of one cylindrical plate can provide a transition to a coaxial waveguide that can end in either a flanged coax joint or a coax transition to rectangular waveguide. It is noted that the location of the hole should be centered to obtain the same electrical path length between the peripheral coax ports and the central coaxial transmission line. The center conductor of this coaxial waveguide can extend across the space between the parallel plates and terminate in a version of, what has historically been called, a "doorknob" transition that contacts the opposite wall.

Within the radial cavity created by the two plates and the peripheral wall, a doorknob transition (hereafter called a doorknob collector when associated with combining signals, and a doorknob emitter when radiating signals) can be located in the center, next to the center conductor, and can have a conical shape with the height and base radius chosen to center the impedance plot of the radial combiner on a Smith Chart over a predetermined range. For example, the range of the impedance plot may be 3.82 GHz to 5.98 GHz.

The peripheral coax ports can be, for example, type-N flange mount jack receptacles with the center conductor of each coaxial port forming a monopole radiator. These connectors may be individually removed or replaced without any disassembly beyond the screws that attach a particular connector to the cylindrical plate to which they are connected. Each monopole radiator can be shaped to provide an impedance match to the radial TEM mode of the signal radiating within the cavity.

Below are simulation results for two exemplary 32-way radial dividers, with a WR187 waveguide common port, are shown below. These examples include the loss of aluminum materials and use a Teflon connector.

TABLE 1

| Frequency Range (GHz) | Frequency Bandwidth (%) | Peak Power (W) (safety factor 4:1) At sea level atmospheric air pressure (standard atmosphere) | Maximum Insertion Loss (dB) | Maximum VSWR | Amplitude Imbalance (dB) | Phase Imbalance (deg.) |
|---|---|---|---|---|---|---|
| 4.4-6.0 | 30 | 125,000 | 0.25 | 1.30:1 | ±0.20 | ±2.0 |
| 5.3-6.0 | 12 | 150,000 | 0.10 | 1.10:1 | ±0.10 | ±1.0 |

Having provided a general description of the invention, the disclosure now turns to the specific examples illustrated by the figures.

An exemplary radial combiner is discussed with respect to FIGS. 1-6.

FIG. 1 illustrates an isometric view of an exemplary radial combiner 100. The radial combiner 100 as illustrated has a top plate 108 and an outside wall 110. The top plate 108 is circular cross-section and has a metallic composition. Attached to the top plate 108 are coaxial ports 102. In this example, each of the coaxial ports is attached to the top plate 108 with a connector plate 104, though in some configurations the connector plate 104 may not be necessary. A base 112 of a transition to a waveguide is provided at the bottom of the radial combiner 100.

Figure 2:
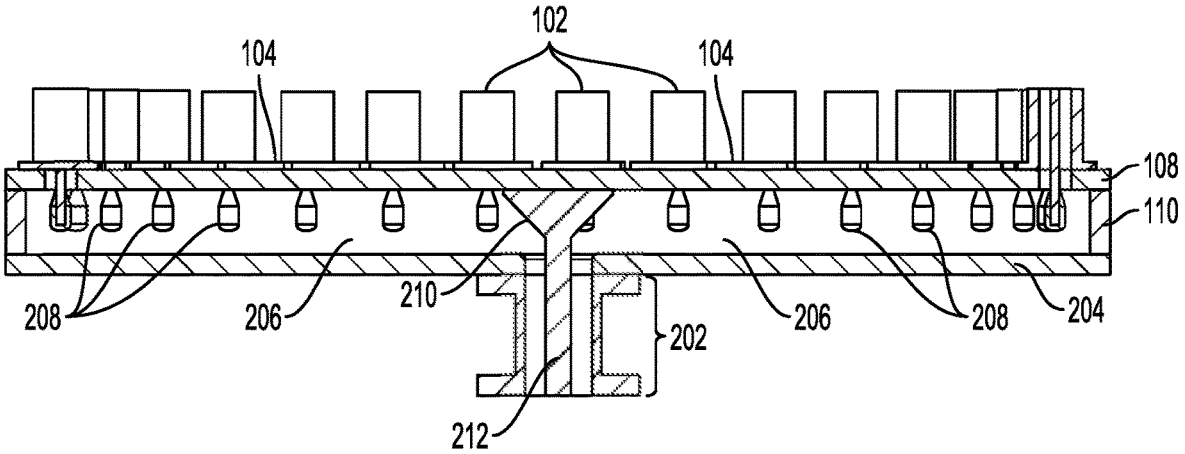
FIG. 2 illustrates a lateral sectional view of the exemplary radial combiner of FIG. 1.

FIG. 2 illustrates a lateral sectional view of the exemplary radial combiner 100. In this example, the top plate 108, the outside wall 110 (also known as the peripheral wall), and a bottom plate 204 form a radial cavity 206. The bottom plate 204 has a circular cross-section, a metallic composition, and being situated substantially parallel to the top plate 108. The outside wall 110 connects to the top plate 108 and the bottom plate 204, with a circumference of at least one of the top plate 108 or the bottom plate 204. Above the top plate 108 are the coaxial ports 102, with the accompanying connector plates 104. The coaxial ports 102 are mounted normal with respect to the top plate 108. For each of the coaxial ports 102, there is a hole through the top plate 108 connecting each coaxial port 102 to a corresponding monopole radiator 208 within the radial cavity 206, the connection occurring via a coaxial central conductor (such as a wire) connecting the coaxial port 102 with the monopole radiator 208. In other embodiments, the monopole radiators 208 can be replaced with distinct types of radiators, such as dipole antennas. In some embodiments, the monopole radiators 208 are all a single type of monopole antenna (such as a whip, rubber ducky, helical, random wire, umbrella, etc.) whereas in other embodiments the monopole radiators 208 are of mixed type (such as some whip monopole radiators, some rubber duckies, etc.).

FIG. 2 further illustrates a "doorknob" collector 210 located at the center of the top plate 108, next to the center conductor which descends into a transition 202 to a waveguide. The doorknob collector 210 is referred to as a "doorknob" collector 210 due to its shape resembling half section of a common doorknob, namely a wide base angling, or curving, to a distal height. The doorknob collector 210 may be conical in shape and approximately centered below the center of the top plate 108. Instead of a "doorknob" collector 210, the transition 210 may be an "L transition" or other device designed to provide impedance matching. More specifically, any collector 210 may be used which matches the characteristic impedance of the center conductor 212 to the output over the useful bandwidth of radiated signal while minimizing discontinuities arising from the geometry of the transition device 210. In other words, the doorknob collector 210 may be used to keep the voltage standing wave ratio at a constant minimum over a specified bandwidth in both the radial combiner cavity 206 and in the center conductor 212.

When being used as a radial combiner 100, the multiple coaxial ports 102 can be simultaneously excited by individual sold state amplifiers, which in turn will excite a radial TEM mode within the cavity 206. The radial TEM mode will propagate toward the center of the cavity 206 and couple into the center conductor 212, which preferably is a coaxial transmission line. The center conductor 212 is part of a transition 202 linking the radial combiner 100 to an output, such as a waveguide or coaxial output.

In some embodiments, the doorknob collector 210 can extend through an entirety of the height of the cavity 206, whereas in other embodiments the doorknob collector 210 will only extend partially through the cavity 206. The center conductor 212 physically connects to the doorknob collector 210 regardless of which configuration is used, then continues into the transition 202 to an output as described below. The center conductor 212 is normal to the circular cross-section of the top plate or the bottom plate, and extends within the interior of the radial waveguide cavity 206 between the top plate 108 and the bottom plate 204. The center conductor 212 transitions, on a first side of the interior, to a coaxial waveguide 202 located exterior to the radial waveguide cavity 206, and terminates, on a second side of the interior which is opposite the first side, in a conically shaped dome (aka the doorknob collector 210).

Figure 3:
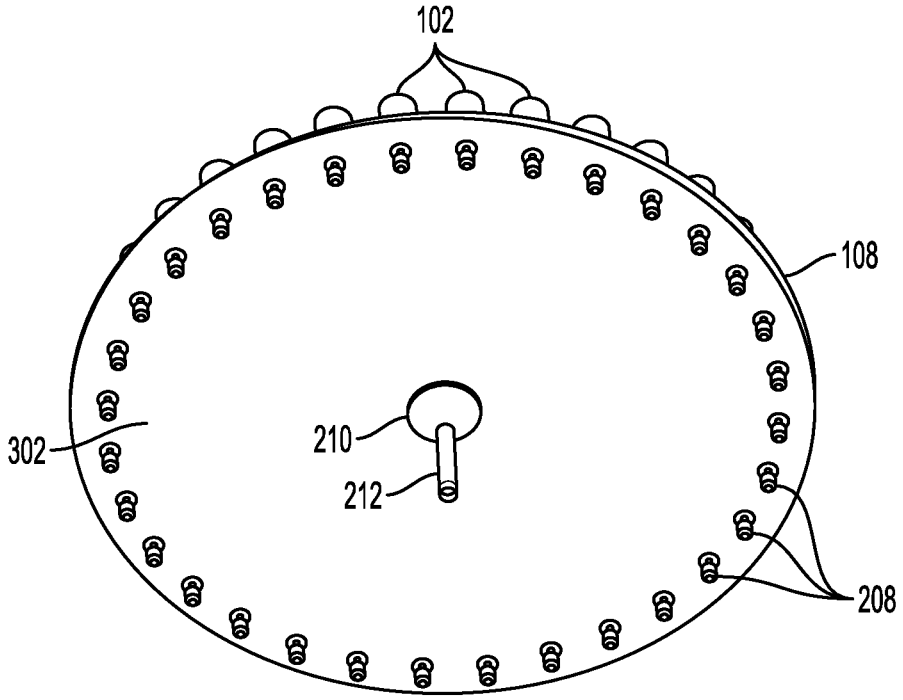
FIG. 3 illustrates an isometric view of a top plate of the exemplary radial combiner of FIG. 1.

FIG. 3 illustrates an isometric view of the top plate 108 of the exemplary radial combiner 100. This view emphasizes the interior 302 of the top plate 108, with the coaxial ports 102 barely visible. The monopole radiators 208 are located around the periphery of the top plate 108. In an exemplary embodiment, the monopole radiators 208 may be spaced around a circle inset from the perimeter of the top plate 108. Further, the monopole radiators 208 may be approximately equally spaced around a circle approximately equally inset from the perimeter of the top plate 108. The doorknob collector 210 and the center conductor 212 are also visible in this view.

Figure 4:
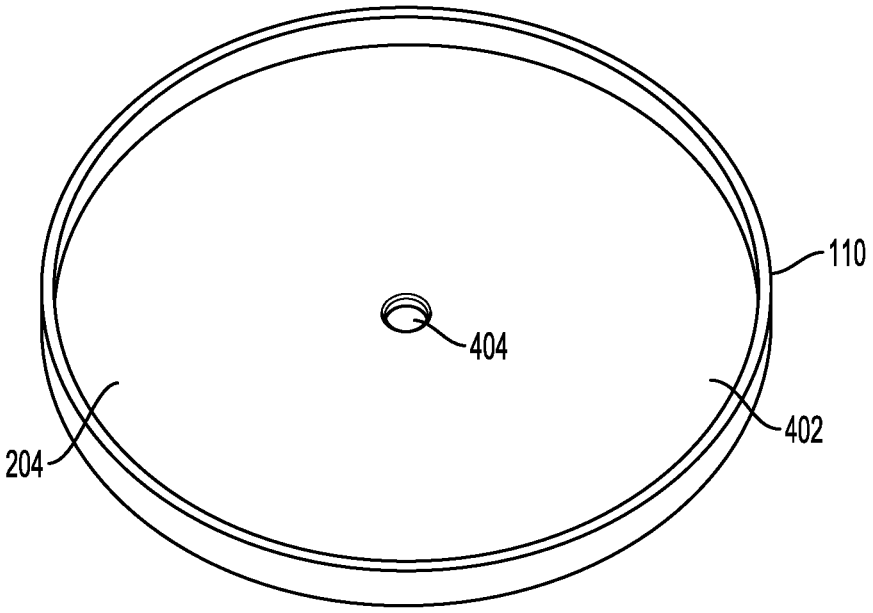
FIG. 4 illustrates an isometric view of a bottom plate of the exemplary radial combiner of FIG. 1.

FIG. 4 illustrates an isometric view of the bottom plate 204 of the exemplary radial combiner 100. This view emphasizes the interior 402 of the bottom plate 204. The bottom plate 402 includes a hole 404 through which the center conductor 212 can pass. The doorknob collector 210 cannot pass through the hole 404 of the bottom plate 204. As illustrated, the bottom plate 402 is shown attached to the outside wall 110. However, how the bottom plate 402, the outside wall 110, and the top plate 108 are formed and combined does not affect functionality. For example, the bottom plate 402, the outside wall 110, and the top plate 108 can all be individually formed, then combined during manufacture of the radial combiner 100. In another case, the bottom plate 402 and the outside wall 110 can be formed as one integrated unit, then combined with the top plate 108. In other cases the top plate 108 and the outside wall 110 may be formed jointly, then combined with the bottom plate 402, or the bottom plate 402, the outside wall 110, and the top plate 108 may all be formed together as a single integrated unit.

Figure 5:
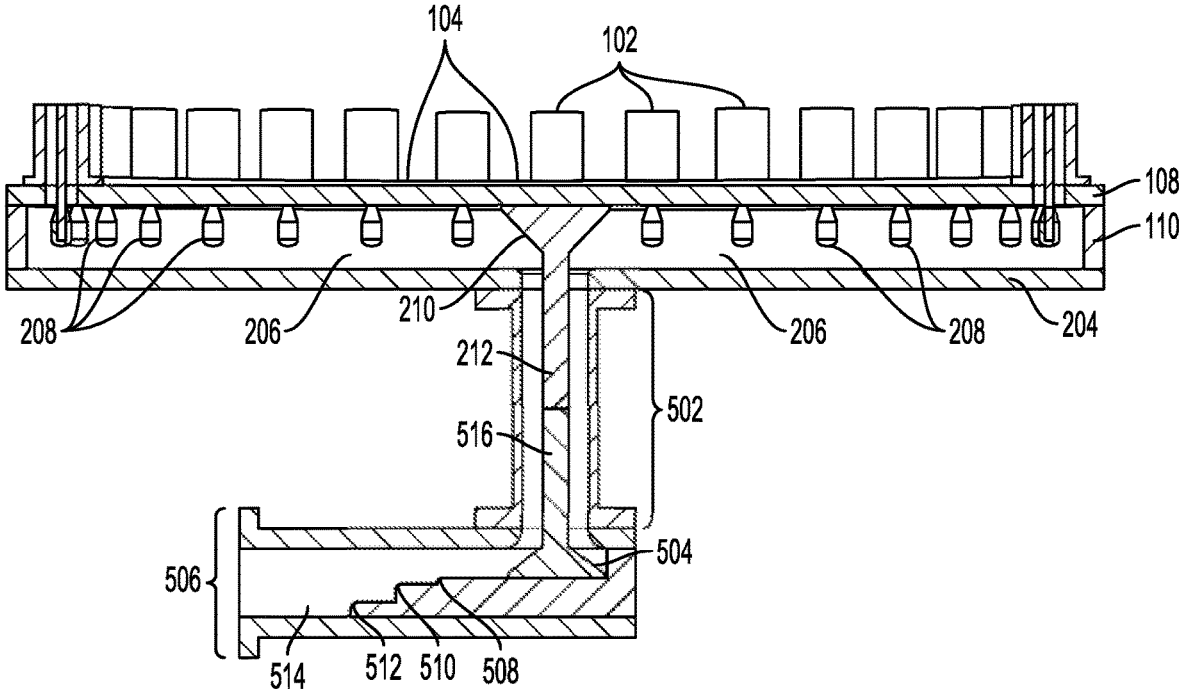
FIG. 5 illustrates a lateral sectional view of the exemplary radial combiner of FIG. 2 with a different transition and a waveguide.

FIG. 5 illustrates a lateral sectional view of the exemplary radial combiner 100 illustrated in FIG. 2, further including an extended transition 502 and a rectangular waveguide 506. The extended transition 502 replaces the transition 202 in FIG. 2, and contains both the center conductor 212 as well as an output conductor 516. The transition 502 functions as a coaxial waveguide conveying the combined signal from the radial waveguide cavity 206 to an output. Exemplary outputs can include a coaxial output or a rectangular waveguide output 506.

The transition 502 is located substantially at a center of the radial waveguide cavity 206, and is normal to the circular cross-section of the top plate 108 or the bottom plate 204. The transition 502 contains the center conductor 212 and the output conductor 516, which together form a transition center conductor 212, 516. The center conductor 212 extends across the interior of the radial waveguide cavity 206 between the top plate 108 and the bottom plate 204, and can be at least partially surrounded by the doorknob collector 210 before entering the transition 502 portion. Likewise, the output conductor 516 illustrated extends into the rectangular waveguide 506, and can be at least partially surrounded by the doorknob emitter 504.

As described above, the multiple coaxial ports 102 can be simultaneously excited by individual sold state amplifiers, which in turn will excite a radial TEM mode within the cavity 206. The radial TEM mode will propagate toward the center, then be combined into the center conductor 212 for transmission to the rectangular waveguide 506. To reach the rectangular waveguide 506 from the radial cavity 206, the center conductor 212 carries the combined signal from the radial cavity 206 to an output conductor 516. In embodiments where the combined signal output is a coaxial signal, the rectangular waveguide 506 will not be present, and the output conductor 516 will conduct the combined signal to an output location. In the illustrated embodiment, the output is a radiated signal through the rectangular waveguide 506, so the output conductor 516 connects to a doorknob emitter 504. That is, the combined signal propagates down the output conductor 516, then radiates from the output conductor 516 into the rectangular waveguide 506.

Because the center conductor 212 joins with the output conductor 516, there can be an impedance mismatch if the center conductor 212 and the output conductor 516 are not properly selected and formed. As is typical in coaxial waveguide connections, the center conductor of the cavity probe and the center conductor of the waveguide probe can be joined by a coaxial "button". Each end of the button is inserted into a hole in the ends of the coaxial center conductors.

As stated above, in some embodiments the output can be a coax line carrying the combined signal, such as the output conductor 516. However, as illustrated in FIG. 5, the signal is radiated out of a rectangular waveguide 506. More specifically, the output conductor 516 extends from the center conductor 212 and into the rectangular waveguide 506. In this example, the output conductor 516 terminates in a doorknob emitter 504, and the output conductor 516 radiates the combined signal into the rectangular waveguide cavity 514. Radiation from the second coaxial transmission line 516 propagates into the waveguide 506. To ensure proper impedance matching for a desired frequency range, the doorknob emitter 504 and/or a series of steps 508, 510, and 512 can be included in the waveguide 506, gradually opening into a wider cavity 514. Although three steps 508, 510, and 512 are illustrated, more or less than three steps may be included in the waveguide 506 depending on the specific frequency range of the combined signal. The resulting electromagnetic wave may then exit the waveguide 506.

Figure 6:
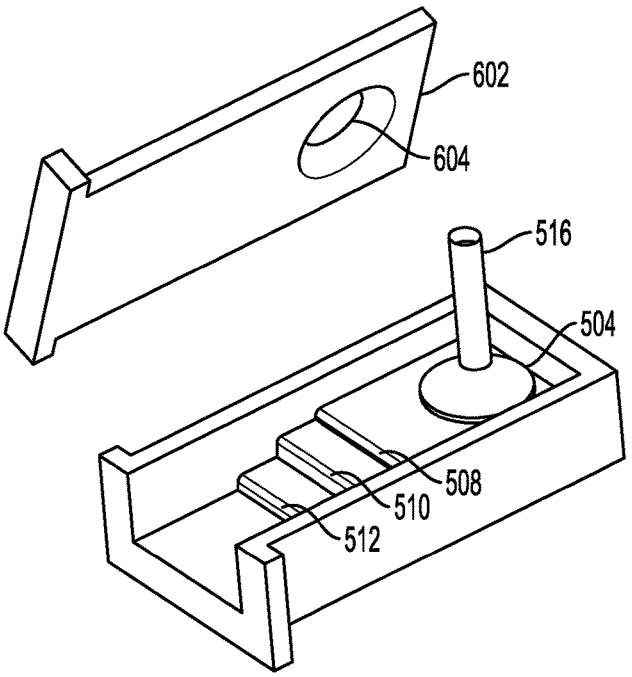
FIG. 6 illustrates an isometric view of the waveguide of FIG. 5.

FIG. 6 illustrates an isometric view of the rectangular waveguide 506 of FIG. 5. As illustrated, the output conductor 516 may connect to the doorknob emitter 504, and the combined signal can radiate from the output conductor into the air within the rectangular waveguide 506, with steps 508, 510, and 512 providing impedance matching. A top portion 602 of the rectangular waveguide 506 may include a hole 604 through which the output conductor 516 may pass through.

Figure 7:
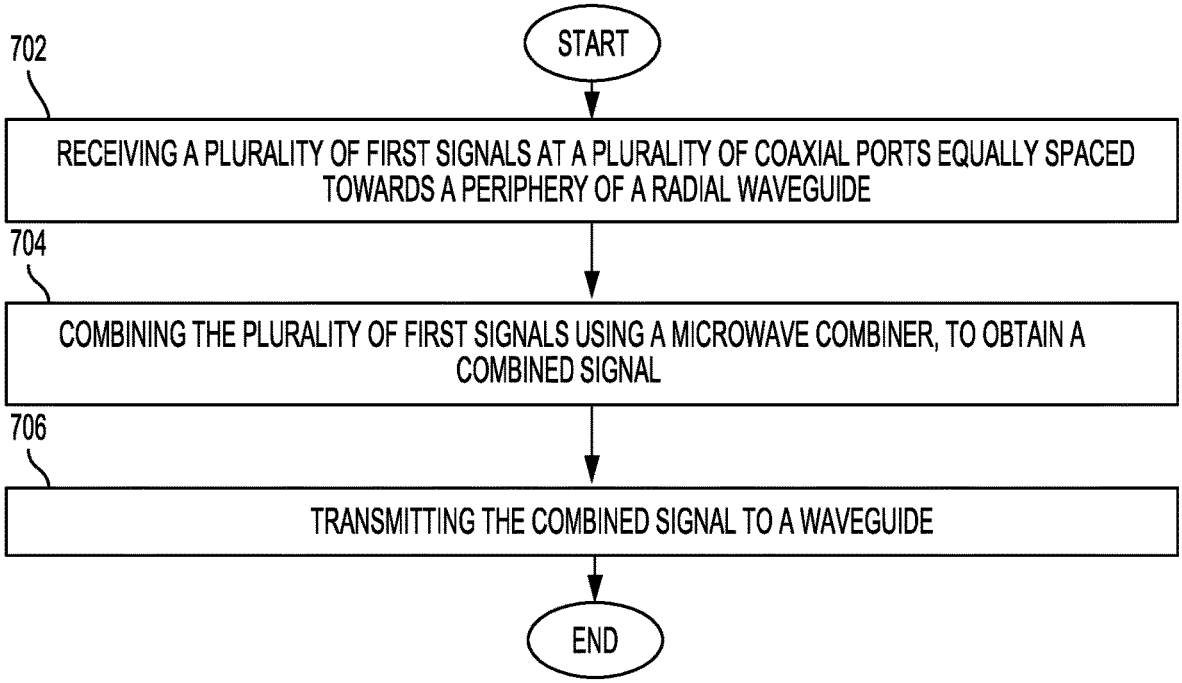
FIG. 7 illustrates an exemplary method of using the exemplary radial combiner of FIG. 1.

FIG. 7 illustrates an exemplary method of using the exemplary radial combiner 100 of FIGS. 1-6, or any radial combiner configured according to the concepts disclosed herein. In this example, the radial combiner 100 receives a plurality of first signals at a plurality of coaxial ports 102 equally spaced towards a periphery of a radial waveguide (702). The radial combiner 100 combines the plurality of first signals using a microwave combiner, to obtain a combined signal (704), and transmits the combined signal to a waveguide 506 (706).

With the invention, a dielectric is not needed within the radial combiner cavity 206. For example, the cavity 206 of the radial waveguide 100 lacks a dielectric, such as one or more internal walls, baffles, or other additional metallic material. In other words, the interior of the radial waveguide 100 lacks a dielectric and also lacks incorporated air (such as air which is sealed within the radial waveguide 100), and instead uses atmospheric air. For example, a typical embodiment can include a "weep hole" at the bottom of a vertically mounted waveguide.

In some embodiments, the interior cavity 206 of the radial waveguide 100 can have a substantially uniform height, whereas in other embodiments the interior can vary in height. In those modes with a substantially uniform height, the substantially uniform height of the interior of the radial waveguide cavity 206 may only support a dominant Transverse Electromagnetic (TEM) radial mode for a band of interest. In such embodiments, each respective monopole radiator 208 may be shaped to match an impedance required for the dominant TEM radial mode. The shape of the monopole radiators 208 can be determined, for example, by using Electromagnetic (EM) simulation software to provide an impedance match to the dominant TEM radial mode when all coaxial ports are equally excited. This matching can include the mutually coupled energy from all neighboring monopulse radiators.

In some embodiments, upon being radiated, the rectangular waveguide 506 receiving the radiated combined signal can use impedance matching steps 508, 510, and 512. In other embodiments, there may be no steps or transitions into the coaxial waveguide 506 from where the doorknob emitter 504 is located.

The coaxial ports 102 are mounted normally to at least one of the top plate 108 or the bottom plate 204. In some embodiments, all of the coaxial ports 102 and all of the monopole radiators 208 are mounted on either the top plate 108 or the bottom plate 204. In other configurations, there can be some coaxial ports 102 and corresponding monopole radiators 208 on both the top plate 108 and the bottom plate 204, provided the 180 degree phase difference between the top plate 108 and the bottom plate 204 is accounted for. Likewise, the doorknob collector 210 may be mounted on the top 108 or bottom plate 204, depending on the configuration. However, in such a case, the doorknob collector 210 is located opposite the hole 404 through which the center conductor 212 passes.

In some embodiments, all of the monopole radiators 208 are mounted on either the top plate 108 or the bottom plate 204, and the other one of the top plate 108 or the bottom plate 204 includes a hole 404 located substantially at a center of the top plate 108 or the bottom plate 204. In such configurations, the transition center conductor 212 can extend through the hole 404 to an exterior of the radial waveguide cavity.

In some embodiments, the rectangular waveguide 506 may include a plurality of steps 508, 510, and 512, each subsequent step in the plurality of steps 508, 510, and 512 expanding the cavity 514 of the rectangular waveguide 506 when compared to a previous step in the plurality of steps.

Use of language such as "at least one of X, Y, or Z" or "at least one or more of X, Y, or Z" are intended to convey a single item (just X, or just Y, or just Z) or multiple items (i.e., {X and Y}, {Y and Z}, or {X, Y, and Z}). "At least one of" is not intended to convey a requirement that each possible item must be present.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

I claim:

1. A radial combiner, comprising:

a radial waveguide cavity defined by:

a top plate having a circular cross-section and a metallic composition;

a bottom plate having a circular cross-section, a metallic composition, and being situated substantially parallel to the top plate;

an outside wall connecting the top plate and the bottom plate along a circumference of at least one of the top plate and the bottom plate; and an interior of the radial waveguide cavity located between the top plate, the bottom plate, and the outside wall with a substantially uniform height throughout;

a plurality of monopole radiators located within the interior of the radial waveguide cavity;

a plurality of coaxial ports mounted on one of the top plate or the bottom plate, mounted exterior to the radial waveguide cavity, and substantially equally spaced towards a periphery of the radial waveguide cavity, each coaxial port in the plurality of coaxial ports:

being mounted so as to be normal relative to the top plate or the bottom plate; and having a coaxial center conductor which extends through a hole in one of the top plate and the bottom plate, the coaxial center conductor of each coaxial port being electrically connected to one of the respective monopole radiators for each coaxial port within the interior of the radial waveguide cavity; and a center conductor, wherein the center conductor:

is located substantially at a center of the interior of the radial waveguide cavity;

is positioned so as to be normal relative to the top plate or the bottom plate;

extends within the interior of the radial waveguide cavity between the top plate and the bottom plate;

transitions, on a first side of the interior, to a coaxial waveguide located exterior to the radial waveguide cavity; and terminates on a second side of the interior which is opposite the first side.

2. The radial combiner of claim 1, wherein the substantially uniform height of the interior of the radial waveguide cavity only supports a dominant Transverse Electromagnetic (TEM) radial mode for a band of interest.

3. The radial combiner of claim 2, wherein each respective monopole radiator is shaped to match an impedance required for the dominant TEM radial mode.

4. The radial combiner of claim 2, wherein the conically shaped dome and the center conductor transform the dominant TEM radial mode to or from the coaxial waveguide.

5. The radial combiner of claim 1, wherein the lack of a dielectric includes a lack of internal walls, baffles, and other additional metallic material within the interior.

6. The radial combiner of claim 1, wherein the coaxial waveguide outputs to a rectangular waveguide.

7. The radial combiner of claim 1, wherein the interior lacks a dielectric.

8. The radial combiner of claim 1, wherein all of the coaxial ports and all of the monopole radiators are mounted on either the top plate or the bottom plate.

9. The radial combiner of claim 1, wherein a conically shaped dome of the transition and all of the monopole radiators are mounted on either the top plate or the bottom plate.

10. The radial combiner of claim 1, wherein either the top plate or the bottom plate includes a hole located substantially at a center of the top plate or the bottom plate, and the center conductor extends through the hole to an exterior of the radial waveguide cavity, the exterior being the coaxial waveguide.

11. The radial combiner of claim 1, wherein all of the monopole radiators are mounted on either the top plate or the bottom plate, and the other one of the top plate or the bottom plate includes a hole located substantially at a center of the top plate or the bottom plate.

12. The radial combiner of claim 1, wherein the coaxial waveguide comprises a plurality of steps, each subsequent step in the plurality of steps expanding a cavity of the coaxial waveguide when compared to a previous step in the plurality of steps.

13. A method comprising:

receiving a plurality of first signals at a plurality of coaxial ports equally spaced towards a periphery of a radial waveguide; and combining the plurality of first signals using a microwave combiner, wherein the microwave combiner comprises:

a radial waveguide cavity defined by:

a top plate having a circular cross-section and a metallic composition; a bottom plate having a circular cross-section, a metallic composition, and being situated substantially parallel to the top plate;

an outside wall connecting the top plate and the bottom plate along a circumference of at least one of the top plate and the bottom plate; and an interior of the radial waveguide cavity located between the top plate, the bottom plate, and the outside wall with a substantially uniform height throughout;

a plurality of monopole radiators located within the interior of the radial waveguide cavity, wherein the plurality of coaxial ports are mounted on one of the top plate or the bottom plate, mounted exterior to the radial waveguide cavity, and substantially equally spaced towards the periphery of the radial waveguide cavity, wherein each coaxial port in the plurality of coaxial ports: is mounted so as to be positioned normal relative to the top plate or the bottom plate; and is a coaxial center conductor which extends through a hole in one of the top plate and the bottom plate, the coaxial center conductor of each coaxial port being electrically connected to one of the respective monopole radiators for each coaxial port within the interior of the radial waveguide cavity; and a center conductor, wherein the center conductor:

is located substantially at a center of the interior of the radial waveguide cavity;

is positioned so as to be normal relative to the top plate or the bottom plate;

extends within the interior of the radial waveguide cavity between the top plate and the bottom plate;

transitions, on a first side of the interior, to a coaxial waveguide located exterior to the radial waveguide cavity; and terminates on a second side of the interior which is opposite the first side.

14. The method of claim 13, wherein the substantially uniform height of the interior of the radial waveguide cavity only supports a dominant Transverse Electromagnetic (TEM) radial mode for a band of interest.

15. The method of claim 14, wherein each respective monopole radiator is shaped to match an impedance required for the dominant TEM radial mode.

16. The method of claim 14, wherein a conically shaped dome and the center conductor transform the dominant TEM radial mode to or from the coaxial waveguide.

17. The method of claim 13, wherein the lack of a dielectric includes a lack of internal walls, baffles, and other additional metallic material within the interior.

18. The method of claim 13, the coaxial waveguide outputs to a rectangular waveguide.

19. The method of claim 13, the coaxial waveguide ending in a coaxial port.

20. A radial combiner, comprising:

a hollow cylindrical cavity, wherein the hollow cylindrical cavity:

is metallic;

is defined by a first plate as a top of the hollow cylindrical cavity, a second plate as a top of the hollow cylindrical cavity, and an outside wall as a side of the hollow cylindrical cavity, the first plate being substantially parallel to the second plate; and has a substantially uniform height between the first plate and the second plate;

a plurality of coaxial ports mounted exterior to the hollow cylindrical cavity and on either one of the first plate or the second plate;

a plurality of monopole radiators substantially equally spaced around a circle and attached to an interior of one of the first plate or the second plate, each monopole radiator being electrically connected respectively to one of the plurality of coaxial ports using a coaxial center conductor extending through a hole in the one of the first plate or the second plate; and a center conductor, wherein the center conductor:

is located substantially at a center of an interior of the hollow cylindrical waveguide cavity;

is positioned so as to be normal relative to the first plate or the second plate;

extends within the interior of the hollow cylindrical cavity between the first plate and the second plate;

transitions, on a first side of the interior, to a coaxial waveguide located exterior to the hollow cylindrical cavity; and terminates, on a second side of the interior which is opposite the first side.

* * * * *